United States Patent [19]

Sandman et al.

[11] 4,230,461

[45] Oct. 28, 1980

[54] ABRASIVE WHEELS

[75] Inventors: Michael A. Sandman, Brookline; Bernard T. Loughlin, Leicester, both of Mass.

[73] Assignee: Eli Sandman Company, Worcester, Mass.

[21] Appl. No.: 837,823

[22] Filed: Sep. 29, 1977

[51] Int. Cl.[3] ..... B24D 3/28; B24D 11/02

[52] U.S. Cl. ..... 51/295; 51/297; 51/298; 428/255; 428/268; 428/273

[58] Field of Search ..... 51/298, 295, 297; 156/36, 91, 94, 162; 428/255, 265, 269, 268, 261, 262, 273, 278, 290, 349

[56] References Cited

U.S. PATENT DOCUMENTS

| | | | |
|---|---|---|---|
| 2,521,911 | 9/1950 | Greenlee | 51/298 |
| 2,763,105 | 9/1956 | Feeley | 51/298 |
| 2,805,136 | 9/1957 | O'Neil | 51/298 |
| 3,540,869 | 11/1970 | Bauer | 51/298 |
| 3,631,638 | 1/1972 | Yoshikawa | 51/298 |
| 3,840,357 | 10/1974 | Shimizu | 51/298 |
| 3,918,218 | 11/1975 | Zoiss | 51/298 |

*Primary Examiner*—Donald J. Arnold

*Attorney, Agent, or Firm*—Robert L. Goldberg; George W. Neuner

[57] ABSTRACT

This invention relates to improved fabrics used in the reinforcement of resin-bonded abrasive wheels. The fabrics are characterized by a coating of a novolak resin essentially free of added crosslinking agents.

19 Claims, No Drawings

ABRASIVE WHEELS

BACKGROUND OF THE INVENTION

1. Introduction

This invention relates to coated fabrics used in the reinforcement of resin-bonded abrasive wheels.

2. Description of the Prior Art

Resin-bonded abrasive wheels are well-known in the art and described in numerous publications. They are used for a variety of purposes such as the cutting of various materials including metals and concrete, for grinding, sanding, buffing and other procedures known to the art. Typically, resin-bonded abrasive wheels may be reinforced with various materials such as random fibers and variously shaped woven and non-woven fabrics. Exemplary fabric materials comprise cotton, nylon, glass, rayon and aramid such as that marketed under the trade name Kelvar. These reinforcements provide a margin of safety in the event that the abrasive wheel cracks or breaks during use and thereby increase the safe operating speed and efficiency of the wheel.

It is known in the art that when woven fabric is used as a reinforcing material for an abrasive wheel, the fabric is coated with a resin to protect the fibers from degradative abrasive attack by the abrasive particles during molding, to allow proper bonding between the resin in the wheel and the fabric reinforcement and to prevent the fabric from distorting. The resins most frequently used for such purposes are the phenolic resins, most often the phenol formaldehyde resins. The protection of fabric, particularly glass fabric, with thermosetting phenolformaldehyde resins prior to preparation of an abrasive wheel is illustrated in U.S. Pat. Nos. 2,745,224; 2,808,688; and U.S. Pat. No. Re 25,303, each of which is incorporated herein by reference.

For preparing coated fabrics for the reinforcement of abrasive wheels, it is believed that only thermosetting resins are used. The most commonly used resins are the resole phenolics which will cure to form an infusible three-dimensional matrix upon heating. The resole resins are known by such names as single-stage, one-step and reactive resins. Less frequently, novolak type phenolic resins have been used for coating fabrics in the preparation of reinforcing discs, but always in combination with a crosslinking agent such as hexamethylenetetramine so that upon heating, the resin will cure and form a three-dimensional crosslinked matrix. In such case, the novolak is a thermosetting material. Typically, from 5 to 15% by weight hexamethylenetetramine is added to the novolak resin. The combination of the novolak resin and the crosslinking agent is typically identified as a two-step or two-stage resin.

A problem encountered with known resin-coated or impregnated fabric reinforcements is that with extended storage before use, the fabrics stiffen and lose their desirable flow characteristics. This results in poorer performance possibly as a consequence of a decrease or loss of chemical bond between the resin matrix for the abrasive particles and the resin coating over the reinforcing fabric. As a consequence, the useful life of the reinforcement is limited significantly, and wheels made with aged reinforcements of this type may not be satisfactory in performance or safety, in the case of wheels made by the "cold press" method.

STATEMENT OF THE INVENTION

The present invention is based upon the discovery that if the reinforcing fabric is coated with novolak phenolic resin essentially free of added crosslinking agent rather than a thermosetting resin as in the prior art, the problems encountered with extended storage are, for the most part, avoided. Hence, fabric reinforcements of the subject invention are characterized by an ability to withstand longer storage without significant degradation of their desirable use properties. In addition, it has been found that the abrasive wheels reinforced with fabric of the subject invention exhibit greater hinge strength when broken or cracked, improved grinding efficiency, improved grinding characteristics, markedly reduced tendency toward blistering of the resin in the finished wheel, and a lessened tendency of the finished wheel to warp.

In accordance with the above, the subject invention provides new materials for the reinforcement of abrasive wheels comprising a reinforcing fabric having a coating of a novolak phenolic resin.

DESCRIPTION OF THE PREFERRED EMBODIMENTS

The fabric, used in the form of a disc or any other convenient shape, may be any of those used in the prior art. However, cloth of a high strength material is preferred. Typical cloths comprise cotton, dacron, rayon, nylon, Kelvar and glass, glass being most preferred, especially open mesh glass fabric.

In accordance with the invention, the cloth is coated with a novolak phenolic resin. The term novolak phenolic resin is defined for purposes herein as a novolak type phenolic resin with little or no added crosslinking agent. Thus, the term excludes the resole resins and the two-stage novolak resins where the crosslinking agent is added in anything other than a minor amount. In accordance with this definition, in the most preferred embodiment of the invention, a novolak resin is used completely free of added crosslinking agent though amounts of crosslinking agent up to a maximum of 3% by weight can be tolerated with the understanding that the results obtained with this quantity of added crosslinking agent are less desirable than when the novolak is free of added crosslinking agent.

The resin is coated onto the fabric in conventional manner such as by immersing the cloth in a varnish of the resin where the varnish comprises a solvent such as an alcohol having a resin solids content varying within relatively broad limits dependent upon the desired percentage resin content of the reinforcement. The varnish may contain other additives as is conventional such as internal or added plasticizers. The solids content of the varnish can typically vary between about 25 and 80% by weight, but preferably ranges between about 60 and 75% by weight.

After the fabric is coated with varnish, it is dried preferably at elevated temperatures to more rapidly remove solvent. Temperatures of from 150° to 450° F. are suitable for periods of time ranging between a fraction of a minute and 30 minutes. Following drying, the cloth may be cut to any desired shape, for the fabrication of an abrasive wheel reinforcement.

The following example illustrates the preparation of a reinforcing shape in accordance with the invention.

EXAMPLE 1

A woven glass cloth identified as Style 500 of the Greenville Mills Division of Warwick Mills Corporation was selected. The cloth had a weight of 9.2 oz. per square yard of material. It was coated with a varnish consisting of 70% by weight of a novolak resin dissolved in methyl alcohol. The novolak resin used was identified as GP2173 of the Georgia Pacific Corporation. The varnish did not contain added crosslinking agent. Following coating of the glass cloth with varnish, the cloth was dried by passing it through an oven at a speed of 20 feet per minute. The oven measured 20 feet in length and was maintained at a temperature of 240° F. The dwell time of the cloth in the oven was one minute. Following drying, the novolak content of the coated glass cloth was 30% of the total weight. The glass cloth was then cut into circular discs having a diameter of 9 inches. The discs are suitable for the reinforcement of abrasive wheels.

To fabricate an abrasive wheel using the reinforcing discs of this invention, any conventional abrasive material may be used. The most commonly used materials are aluminum oxide and silicon carbide grains though other abrasives such as garnet or even diamonds can be used. Aluminum oxide abrasive is available in several different grades including a brown abrasive which is about 95% aluminum oxide and a white porous variety which is about 98% pure or better. Silicon carbide abrasive is also available in several different grades such as the black grades and the green, the latter being the purer grade. The abrasive particles, which are commercially available with a resin coating, are mixed with a resin and molded to bind the abrasive particles into a coherent structure. In this case, the resin used as the binder for the abrasive particles is also a phenolic resin, but unlike the resin used to coat the reinforcing fabric, is thermosetting rather than thermoplastic. Any of the two-stage novolak resins conventionally used as binders are suitable for this purpose. The relative amount of abrasive to resin binder is as in the prior art, the abrasive generally comprising the predominant portion of the blend. The blend may also contain other conventional additives as is customary in the art.

The formation of a grinding wheel using the reinforcing discs of the invention is illustrated in the following example.

EXAMPLE 2

| | |
|---|---|
| No. 24 grit size aluminum oxide | 1000 grams |
| No. 36 grit size aluminum oxide | 1000 grams |
| Reactive phenol-formaldehyde resin brand BRL 2534, a liquid resin | 80 grams |
| Powdered reactive phenol-formaldehyde resin brand BRP 5417, a resin supplied with hexamethylenetetramine added as a crosslinking agent | 260 grams |
| Furfural | 20 grams |
| Cryolite Powder | 240 grams |
| Anthracene oil fractions from coal tar, carbosote brand | 25 grams |

Blend the above materials together and screen the resulting mix using a No. 12 screen.

Place an interliner disc in the bottom of a circular mold. Using the reinforcing discs of Example 1, place a disc on top of the Patapar interliner noting the direction of the orientation lines. Charge the mold with 133 grams of the above mix and level the mix by running a straight edge over the top of the mold. Place a second reinforcing disc on the top of the mix making sure that the orientation lines of the disc line up with the bottom disc. This is covered with a second interliner disc. The top section of the mold is put in place and the mold transferred to a Wabash press. The press is put under a pressure of 12 tons and held at this pressure for 30 seconds. Thereafter, the mold is removed from the press and the "green" wheel carefully removed from the mold. The "green" wheel is then placed in an oven and cured for 4 hours at 180° F., 2 hours at 220° F., 2 hours at 260° F., 2 hours at 290° F. and then 17 hours at 320° F. The cured wheel is then permitted to cool to room temperature.

It should be understood that the procedures of Example 2 are simplified for purposes of illustration and that in the actual fabrication of an abrasive wheel, as is known in the art, there are many possible variations. For example, it is customary for an abrasive wheel to be of a composite structure comprising one or more abrasive layers and one or more reinforcing shapes.

We claim:

1. A material or shape cut from said material used for the reinforcement of a resin-bonded abrasive wheel, said material or shape of a fabric coated or impregnated with a non-abrasive composition comprising a novolak phenolic resin essentially free of crosslinking agent.

2. The material or shape of claim 1 where the resin is a novolak resin containing a maximum of 3% by weight added crosslinking agent.

3. The material or shape of claim 2 where the novolak resin is a phenol formaldehyde resin.

4. The material or shape of claim 2 where the novolak resin is free of added crosslinking agent.

5. The material or shape of claim 4 where the fabric is woven from yarn made from a member from the group of synthetic resins and fiber glass.

6. The material or shape of claim 5 where the fabric is open-weave glass fabric.

7. A material or shape used for the reinforcement of a resin-bonded abrasive wheel, said material or shape comprising open-weave glass fabric having been coated or impregnated with a non-abrasive composition of a novolak phenolic resin essentially free of added crosslinking agent.

8. The material or shape of claim 7 where the phenolic resin is a novolak resin having less than 3% by weight added crosslinking agent.

9. The material or shape of claim 7 free of added crosslinking agent.

10. The material or shape of claim 7 where the glass is sized with starch.

11. The material or shape of claim 7 where the novolak resin comprises less than one-half of the total weight of the shaped material.

12. A process for making a material or shape useful for the reinforcement of a resin-bonded abrasive wheel, said process comprising the steps of coating a fabric with a varnish comprising a non-abrasive composition of a novolak phenolic resin dissolved in a solvent essentially free of added crosslinking agent and drying said varnish to remove said solvent.

13. The process of claim 12 where the resin is a phenol formaldehyde novolak resin containing a maximum of 3% by weight added crosslinking agent.

14. The process of claim 12 where the novolak resin is free of added crosslinking agent.

15. The process of claim 12 where the fabric is woven from yarn made from a member of the group of synthetic resins and glass.

16. The process of claim 15 where the fabric is open-weave glass.

17. A resin-bonded abrasive wheel comprising a reinforcing layer of a fabric coated or impregnated with a non-abrasive composition of a novolak phenolic resin essentially free of crosslinking agent and an abrasive layer comprised of abrasive material and a resinous binder.

18. The resin-bonded abrasive wheel of claim 17 wherein said wheel comprises two of said reinforcing layers having said abrasive layer therebetween.

19. A process for making a resin-bonded abrasive wheel, said process comprising:

coating a fabric with a varnish comprising a non-abrasive composition of a novolak phenolic resin essentially free of added crosslinking agent dissolved in a solvent;

drying the varnish coated fabric to remove said solvent;

placing a layer of the dried varnish coated fabric in a mold;

placing a layer comprised of abrasive material and a resinous binder in the mold;

pressing the layers in the mold under sufficient pressure to form a composite; and curing the composite to form said abrasive wheel.

* * * * *